United States Patent [19]

Smith et al.

[11] Patent Number: 4,787,945

[45] Date of Patent: Nov. 29, 1988

[54] HIGH NICKEL CHROMIUM ALLOY

[75] Inventors: Gaylord D. Smith; Curtis S. Tassen, both of Huntington, W. Va.

[73] Assignee: Inco Alloys International, Inc., Huntington, W. Va.

[21] Appl. No.: 135,351

[22] Filed: Dec. 21, 1987

[51] Int. Cl.[4] ..... C22C 19/05

[52] U.S. Cl. ..... 148/428; 148/410

[58] Field of Search ..... 420/443, 445, 446, 447, 420/448, 449; 148/410, 428

[56] References Cited

U.S. PATENT DOCUMENTS

| | | | |
|---|---|---|---|
| 2,813,788 | 11/1957 | Skinner | 420/584 |
| 3,160,500 | 12/1964 | Eiselstein et al. | 420/448 |
| 3,574,604 | 3/1971 | Copson et al. | 420/446 |
| 3,607,243 | 9/1971 | Eiselstein et al. | 420/446 |
| 4,312,682 | 1/1982 | Herchebroeder | 420/443 |
| 4,448,749 | 5/1984 | Sugitani et al. | 420/584 |
| 4,487,744 | 12/1984 | DeBold et al. | 420/584 |
| 4,547,338 | 10/1985 | Grobner et al. | 420/584 |

OTHER PUBLICATIONS

Chemical Abstracts 103-145996j, Jap. Pub. Appln. No. 85-82,639.

*Primary Examiner*—R. Dean

*Attorney, Agent, or Firm*—Raymond J. Kenny; Francis J. Mulligan, Jr.

[57] ABSTRACT

A high-nickel-chromium iron alloy containing aluminum and titanium is particularly useful under high temperature/oxidizing conditions such as encountered in ceramic tile industry frit-firing applications. The alloy also contains a special percentage of nitrogen as well as zirconium.

19 Claims, No Drawings

HIGH NICKEL CHROMIUM ALLOY

The subject invention is directed to a high nickel-chromium-iron (Ni-Cr-Fe) alloy, and particularly to a Ni-Cr-Fe alloy of such composition that it pro se facilitates the manufacture thereof accompanied by yields higher than alloys of similar chemistry while still affording a desired combination of properties at elevated temperature upwards of 2000° F. (1093° C.) under oxidizing conditions. It is an improvement over the alloy described in patent application Ser. No. 881,623 ('623) filed July 3, 1986, now abandoned in favor of U.S. application Ser. No. 59,750 of June 8, 1987, both assigned to the Assignee of the subject application.

BACKGROUND OF THE INVENTION

In '623, the disclosure of which is incorporated herein by reference, a special alloy is described as being particularly useful under high temperature/oxidizing conditions such as encountered by furnace rollers in ceramic tile industry frit-firing applications. The '623 alloy, generally speaking, contains about 19 to 28% chromium, about 55 to 65% nickel, about 0.75 to 2% aluminum, about 0.2 to 1% titanium, up to about 1% each of silicon, molybdenum, manganese and niobium, up to about 0.1% carbon, about 0.04 to 0.1% nitrogen, up to about 0.01% boron, with the balance being essential iron. A preferred composition contains 21 to 25% chromium, 58 to 63% nickel, 1 to 2% aluminum, 0.3 to 0.7% titanium, 0.1 to 0.6% silicon, 0.1 to 0.8% molybdenum, up to 0.6% manganese, up to 0.4% niobium, 0.02 to 0.1% carbon, and 0.04 to 0.08% nitrogen, the balance being essentially iron.

Notwithstanding the attributes of the '623 alloy, improvement in respect of the manufacture thereof is desirable in an effort to reduce cost. Apparently, the desired titanium nitride phase that forms tends to float during the melting process. This flotation renders electroslag remelting difficult particularly where about 0.04% or more nitrogen is a desideratum. Moreover, the tendency of the TiN to segregate to the top of the cast ingots rendered some ingots too inhomogeneous. This causes grinding loses depending on the amount of TiN formed. Too, where the aluminum content significantly exceeded the percentage of titanium, the alloy tended to form AlN such that the amount of free aluminum was depleted whereby it was not available for enhancing oxidation resistance. Furthermore, while titanium was necessary to impart grain-stabilization by reason of the TiN phase (and to minimize AlN formation) it has been observed that excessive titanium detracts from oxidation resistance.

SUMMARY OF THE INVENTION

It has now been found that (1) the manufacturing of alloys of the '623 type can be improved thus benefiting the economics (2) advantageous electroslag remelting can be utilized in alloy manufacture, (3) AlN formation can be suppressed (4) oxidation resistance at temperatures circa 2192° F. (1200° C.) is enhanced (5) and elevated temperature properties such as stress-rupture strength are not detrimentally affected (6) through the incorporation of controlled additions of zirconium in such alloys, particularly in combination with controlled percentages of titanium nitrogen. Other aspects of the instant invention are described hereinafter.

INVENTION EMBODIMENTS

Generally speaking and in accordance with the present invention, the alloy contemplted herein contains about 19 to 28% chromium, about 55 to 75% nickel about 0.75 to 2% aluminum, up to 1% titanium, zirconium in a small but effective amount e.g., 0.05%, sufficient to facilitate the manufacturing process and up to about 0.5%, up to about 1% each of silicon, molybdenum, manganese and niobium, up to 0.1% carbon, from a small but effective amount of nitrogen, e.g., 0.02 or 0.025%, sufficient to combine with zirconium, particularly in conjunction with titanium, to effect and enhance grain size control, the upper level being about 0.1%, up to about 0.01% boron, up to about 0.2% yttrium and with the balance being essentially iron. A preferred alloy contains 21 to 25% chromium, 58 to 63% nickel, 0.8 to 1.5% aluminum, 0.075 to 0.5% titanium, about 0.15 to 0.4% zirconium, 0.1 to 0.6% silicon, up to 0.8%, e.g., 0.1 to 0.6%, molybdenum, up to 0.6% manganese, up to 0.4% niobium, 0.04 to 0.1% carbon, 0.03 to 0.04 to 0.08% nitrogen, up to 0.15% yttrium, with iron constituting essentially the balance.

In addition to the above, it is most advantageous that at least one, preferably all, of the following relationships be observed: Relationship A—the silicon and titanium should be correlated such that the ratio therebetween is from about 0.8 to 3; Relationship B—the zirconium and titanium should be correlated such that the ratio therebetween is at least 0.1 and up to 60; and Relationship C—the aluminum and titanium plus 0.525x% zirconium should be correlated such that the ratio therebetween is not greater than about 5.5 to 1 for service temperatures up to 2192° F. (1200° C.).

Nitrogen plays a major role in effectively enhancing grain size control. It forms a nitride, principally a carbonitride, with zirconium and titanium, the amount being approximately 0.14 to 0.65% $(Zr_xTi_{1-x})C_yN_{1-y}$ depending upon the stoichiometry of the nitride. This level of $(Zr_xTi_{1-x})C_yN_{1-y}$ pins the grain size at temperatures as high as 2192° F. (1200° C.), and stabilizes grain size which, in turn, causes a marked increase in operating life, circa as long as 12 months or longer, at temperatures as high as 2192° F. (1200° C.). Put another way, the presence of nitrogen/carbonitride increases the temperature capability over conventionally used materials by some 135° F. (75° C.) or more. At about 0.015–0.016% nitrogen and below, there would appear to be insufficient precipitate to pin the grain boundaries. Above about 0.08% nitrogen, the alloy tends to become more difficult to weld.

In carrying the invention into practice, care should be exercised in achieving proper composition control. Nickel contributes to workability and fabricability as well as imparting strength and other benefits. It need not exceed 65% since any expected benefit would not be commensurate with the aded cost. Aluminum and chromium confer oxidation resistance but if present to the excess lend to undesirable microstructural phases such as sigma. Little is gained with chromium levels much above 28% or aluminum levels exceeding 1.5%. Actually, scale adhesion begins to decrease at 1.3% aluminum and tends to become excessive at around 1.5% and above.

Carbon need not exceed 0.1% to minimize the formation of excess carbides. A level of about 0.1 to 0.5% $Cr_{23}C_6$ aids strength to about 2057° F. (1125° C.). This is particularly true if one or both of silicon and molybdenum are present to stabilize the carbide phase. In this regard the presence of 0.1 to 0.6% silicon and/or 0.1 to 0.8% molybdenum is advantageous.

Titanium and zirconium serve to form the grain boundary pinning phase, $Zr_xTi_{1-x}C_yN_{1-y}$. Increasing the zirconium content of the nitride phase results in a precipitate of greater density (increasing from about 5.43 for TiN to about 7.09 for ZrN) and somewhat greater chemical stability. This increase in density results in less tendency for the nitride to float out of the melt and permits of electroslag remelting. Zirconium from 0.05 to 0.5%, in conjunction with 0.1 to 0.4% titanium, is sufficient to stabilize a nitrogen range of 0.02 or 0.03 to 0.08%, provided the sum of the atomic weight percent of zirconium plus titanium equals or exceeds the atomic weight percent of nitrogen. A minimum of titanium about 0.05 to 0.2% also quite beneficial in stabilizing the alloy against the formation of AlN, particularly in conjunction with zirconium. At 2192° F. (1200° C.), the aluminum to titanium plus 0.525x% zirconium ratio should be less than about 5.5. This ratio should be extended up to about 10 at 2012° F. (1100° C.) and proportioned between 2192° F. to 2010° F. Thus, at a level of 1.5% aluminum, the titanium and zirconium levels should be at least 0.27% for service at 2192° F. (1200° C.). At a level of 0.75% aluminum, it should preferably be not below 0.135% for service at 2192° F. (1200° C.).

Niobium will further stabilize the carbonitride/nitride, particularly in the presence of zirconium and titanium. While niobium might be used in lieu of zirconium and/or titanium, it is most preferred to use the latter alloying constituents since biobium is a costly element. Further, NbN is not quite as stable as the nitrides of zirconium and titanium.

As noted above herein, control of the percentages of silicon, and titanium should be exercised. At elevated temperature, e.g., 2012° F. (1100° C.) and above, "scale integrity", as reflected by imperviousness to the atmosphere of exposure, and adhesion tenacity of the scale to the alloy surface, particularly during thermal cycling, is most important. We have found that silicon manifests a marked positive influence in respect of scale integrity whereas titanium tends to detract therefrom. The ratio therebetween need not exceed 3 and highly satisfactory results are achieved upon alloy exposure to air at 2012° F. (1100° C.) and above with silicon to titanium ratios of 0.9 to 1.4 or 1.5. A silicon content of at least 0.2 to 0.5% is most preferred. It is thought that other properties could be adversely impacted should the upper limits of both silicon (1%) and titanium (1%) be employed. The ratio may be extended downward to about 0.75 but at the risk of poorer results. It is considered that what has been found in terms of silicon to titanium should be followed in respect of zirconium, and also niobium, if used.

With regard to other elements, manganese is preferably held to low levels, preferably not more than about 0.6%, since higher percentages detract from oxidation resistance. Up to 0.006% boron may be present to aid malleability. Calcium and/or magnesium in amounts, say to 0.05 or 0.1%, are useful for deoxidation and malleabilization. And yttrium improves grain size stabilization characteristics. In this regard, it is preferred that the alloy contain at least about 0.01 or 0.02% yittrium.

Iron comprises essentially the balance of the alloy composition. This allows for the use of standard ferroalloys in melting thus reducing cost. It is preferred that at least 5% and preferably at least 10% iron should be present.

As to other constituents, sulfur and phosphorous should be maintained at low levels, e.g., up to 0.015% sulfur and up to 0.02 or 0.03 phosphorous. Copper can be present.

In terms of processing, conventional air melting procedures may be used, including the employment of induction furnaces. However, vacuum melting and refining can be employed where desired. Preferably the alloy is electric-arc furnace melted, AOD refined and electroslag remelted. The nitrogen can be added to the AOD refined melt by means of a nitrogen blow. The alloy is, as a practical matter, non age-hardenable or substantially non agehardenable, and is comprised essentially of a stable austenitic matrix virtually free of detrimental quantities of subversive phases. For example, upon heating for prolonged periods, say 300 hours, at temperatures circa 1100° F. (593° C.) to 1400° F. (760° C.) metallographic analysis did not reveal the presence of the sigma phase. If the upper levels of both aluminum and titanium are present, the alloy, as will be apparent to a metallurgist, would be age hardenable.

The following information and data are given to afford those skilled in the art a better perspective as the nature of the alloy abovedescribed.

A series of alloys (Table I) were melted either in an air induction furnace (alloy F), or in a vacuum induction furnace (Alloys 1 through 15 and A through C), or in an electric-arc furnace and then AOD refined (Alloys D, E, H J and K). Alloy I was melted in an electricarc furnace, AOD refined and then ESR remelted. Alloys 1 to 15 are within and Alloys A through K are without the invention. Various tests were conducted as reported in Tables II through VIII. (Not all compositions were subjected to all tests).

Ingots were broken down to approximately 0.280 inch hot bands which were then cold rolled into coils approximately 0.08 inch in thickness with two intermediate anneals at 2050° F. (1121° C.) Sheet specimens were annealed at about 2150° F. (1177° C.) for two hours prior to test.

TABLE I

| | COMPOSITION ANALYSIS* | | | | | | | | | | | | |
|---|---|---|---|---|---|---|---|---|---|---|---|---|---|
| Alloy | N | C | Cr | Al | Fe | Ni | Si | Mo | Nb | Mn | Ti | Zr | Y |
| 1 | .030 | 0.05 | 24.60 | 1.42 | 11.51 | 60.33 | 0.48 | 0.32 | 0.01 | 0.28 | 0.40 | 0.10 | — |
| 2 | .028 | 0.06 | 24.55 | 1.44 | 11.58 | 60.38 | 0.49 | 0.32 | 0.01 | 0.38 | 0.39 | 0.11 | 0.01 |
| 3 | .031 | 0.05 | 24.44 | 1.43 | 11.60 | 60.32 | 0.45 | 0.31 | 0.01 | 0.39 | 0.41 | 0.10 | 0.04 |
| 4 | .026 | 0.05 | 24.06 | 1.41 | 11.54 | 60.55 | 0.51 | 0.31 | 0.01 | 0.49 | 0.42 | 0.09 | 0.09 |
| 5 | .036 | 0.05 | 24.26 | 1.40 | 11.36 | 60.31 | 0.49 | 0.34 | 0.01 | 0.41 | 0.38 | 0.30 | 0.01 |
| 6 | .051 | 0.04 | 24.25 | 1.42 | 11.39 | 60.23 | 0.47 | 0.35 | 0.01 | 0.41 | 0.39 | 0.32 | — |
| 7 | .044 | 0.06 | 24.13 | 1.41 | 11.46 | 60.27 | 0.45 | 0.35 | 0.01 | 0.38 | 0.39 | 0.32 | 0.01 |
| 8 | .020 | 0.03 | 23.94 | 1.24 | 0.20 | 73.15 | 0.32 | 0.01 | 0.33 | 0.16 | 0.01 | 0.24 | — |
| 9 | .016 | 0.03 | 23.48 | 1.17 | 0.19 | 73.19 | 0.32 | 0.01 | 0.35 | 0.20 | 0.08 | 0.14 | — |
| 10 | .022 | 0.04 | 22.95 | 1.25 | 13.66 | 60.33 | 0.38 | 0.30 | — | 0.36 | — | 0.14 | — |

TABLE I-continued

| Alloy | N | C | Cr | Al | Fe | Ni | Si | Mo | Nb | Mn | Ti | Zr | Y |
|---|---|---|---|---|---|---|---|---|---|---|---|---|---|
| | COMPOSITION ANALYSIS* | | | | | | | | | | | | |
| 11 | .024 | 0.04 | 23.02 | 1.35 | 13.40 | 60.27 | 0.42 | 0.30 | — | 0.34 | — | 0.32 | — |
| 12 | .024 | 0.03 | 23.28 | 1.33 | 13.39 | 60.24 | 0.44 | 0.30 | — | 0.28 | — | 0.13 | 0.031 |
| 13 | .025 | 0.04 | 23.17 | 1.35 | 13.14 | 60.36 | 0.41 | 0.31 | — | 0.36 | — | 0.32 | 0.021 |
| 14 | .026 | 0.04 | 23.51 | 1.35 | 13.13 | 60.08 | 0.45 | 0.32 | — | 0.30 | 0.11 | 0.16 | — |
| 15 | .026 | 0.04 | 23.20 | 1.31 | 12.86 | 60.49 | 0.43 | 0.31 | — | 0.35 | 0.10 | 0.32 | — |
| A | .018 | 0.03 | 23.70 | 1.30 | 0.18 | 72.22 | 0.33 | 0.01 | 0.35 | 0.22 | 0.33 | <0.01 | — |
| B | .016 | 0.04 | 24.03 | 1.28 | 0.16 | 72.86 | 0.26 | 0.01 | 0.35 | 0.21 | 0.56 | — | — |
| C | .020 | 0.04 | 24.04 | 1.29 | 0.15 | 72.29 | 0.35 | 0.01 | 0.34 | 0.18 | 0.84 | — | — |
| D | 0.02 | 0.01 | 22.30 | 1.09 | 14.08 | 61.99 | 0.12 | 0.14 | 0.04 | 0.29 | 0.33 | — | — |
| E | 0.02 | 0.04 | 23.01 | 1.31 | 13.73 | 61.13 | 0.18 | 0.18 | 0.08 | 0.33 | 0.38 | — | — |
| F | 0.08 | 0.04 | 23.89 | 1.52 | 11.61 | 61.17 | 0.32 | 0.23 | — | 0.29 | 0.37 | — | — |
| G | 0.03 | 0.05 | 23.37 | 1.75 | 13.42 | 59.66 | 0.41 | 0.20 | 0.12 | 0.31 | 0.36 | — | — |
| H | 0.01 | 0.02 | 21.94 | 1.16 | 15.54 | 60.44 | 0.17 | 0.48 | 0.18 | 0.36 | 0.38 | — | — |
| I | 0.04 | 0.06 | 23.87 | 1.44 | 13.59 | 59.97 | 0.51 | 0.47 | 0.33 | 0.35 | 0.24 | — | — |
| J | 0.04 | 0.05 | 23.46 | 1.50 | 15.57 | 58.73 | 0.29 | 0.12 | 0.06 | 0.24 | 0.29 | — | — |
| K | 0.07 | 0.05 | 23.96 | 1.19 | 14.74 | 59.12 | 0.21 | 0.17 | 0.14 | 0.34 | 0.34 | — | — |

*weight percent
niobium less than 0.01 for Alloys 1-7

TABLE II

EFFECT OF THERMAL EXPOSURE AT TIME AND TEMPERATURE

| Alloy | Grain Size in Mils (0.001 in) After 1008 hours/ 2012° F. (1100° C.) | 596 Hours/ 2130° F. (1165° C.) | 504 Hours/ 2192° F. (1200° C.) |
|---|---|---|---|
| 1 | 8 | 9 | 10 |
| 2 | 7 | 7 | 10 |
| 3 | 8 | 7 | 12 |
| 4 | 7 | 6 | 6 |
| 5 | 5 | 5 | 5 |
| 6 | 5 | 7 | 5 |
| 7 | 4 | 7 | 7 |
| 8 | 6 | 7 | 7 |
| 9 | 7 | 7 | 7 |
| 10 | 10 | 10 | 14 |
| 11 | 6 | 7 | 8 |
| 12 | 5 | 10 | 12 |
| 13 | 5 | 6 | 7 |
| 14 | 7 | 8 | 10 |
| 15 | 6 | 7 | 7 |
| A | 12 | 20 | — |
| B | 10 | 14 | — |
| C | 8 | 10 | — |

The effect of zirconium perhaps can be best seen by comparing the Alloy pairs 10 and 11, 12 and 13 and 14 and 15 since the nitrogen contend did not vary greatly. At 1200° C., the grain size was lowest for Alloys 11, 13 and 15, alloys in which the zirconium content was 0.32%. The results were, comparatively speaking, somewhat marginal at the zirconium levels of 0.14, 0.13 and 0.16%, respectively. Alloys such as 5 and 6 benefitted from higher nitrogen levels and the presence of higher percentage of titanium. Alloy C responded rather well due to the high (0.84%) level of titanium, but as above-noted the higher percentages of this constituent tends to detract from oxidation resistance. See Table VI infra.

Stress rupture lives and tensile elongation are given in Table III for various alloys tested at 2000° F. (1092° C.) and 13.78 MPa (2 ksi).

TABLE III

Stress Rupture Lives for Hot Rolled and Annealed Alloys Tested at 2000° F. (1092° C.) and 1378 Mpa (2 Ksi.)

| Alloy | Stress Rupture Life (hours) | Elongation % |
|---|---|---|
| 1 | 25 | 24 |
| 2 | 64 | 56 |
| 3 | 70 | 100 |

TABLE III-continued

Stress Rupture Lives for Hot Rolled and Annealed Alloys Tested at 2000° F. (1092° C.) and 1378 Mpa (2 Ksi.)

| Alloy | Stress Rupture Life (hours) | Elongation % |
|---|---|---|
| 4 | 51 | 112 |
| 5 | 22 | 47 |
| 6 | 25 | 67 |
| 7 | 29 | 84 |
| 10 | 118 | 19 |
| 11 | 88 | 67 |
| 12 | 28 | 62 |
| 13 | 78 | 100 |
| 15 | 49 | 84 |

With regard to the aforediscussed silicon to titanium ratio, data are given in Table IV concerning oxidation performance at 2012° F. (1100° C.) for 1008 hours in an air atmosphere. Mass change data are presented with respect to alloys A, B, C, D, G and 8-15. Little spalling occurred with respect to the alloys of the invention upwards of 1100° C. but was severe for alloys B, E and G. It was observed that with silicon to titanium ratios in accordance with the invention oxidation resistance was appreciably improved.

TABLE IV

| Alloy | % (Si) | (% Ti) | Ratio (Si/Ti) | 1008 hours 2012° F. (1100° C.) (mg/cm$^2$) | 1200° C. |
|---|---|---|---|---|---|
| A | 0.33 | 0.33 | 1.00 | −4.9 | — |
| B | 0.26 | 0.56 | 0.46 | −36.2 | — |
| C | 0.35 | 0.84 | 0.42 | −36.6 | — |
| I | 0.17 | 0.38 | 0.47 | −79.9 | |
| F | 0.12 | 0.33 | 0.47 | −22.2 | |
| 1 | 0.48 | 0.40 | 1.20 | −8.7 | |
| 2 | 0.49 | 0.39 | 1.26 | −10.3 | |
| 3 | 0.45 | 0.41 | 1.10 | −11.0 | |
| 8 | 0.32 | 0.01 | 32 | −25.6 | — |
| 9 | 0.32 | 0.08 | 4.00 | −2 | — |
| 10 | .38 | — | * | −9.3 | −31.4 |
| 11 | .42 | — | * | −8.3 | −31.7 |
| 12 | .44 | — | * | −3.4 | −29.0 |
| 13 | .41 | — | * | −7.0 | −27.1 |
| 14 | .45 | .11 | 4.09 | −9.8 | −41.5 |
| 15 | .43 | .10 | 4.3 | −9.1 | −34.5 |

*infinity

The aluminum content of the subject alloy must be controlled in seeking optimum oxidation resistance at elevated temperatures. Table V presents the oxidation resistance of various alloys at Table I. The rate of scale spall tends gradually to increase as the aluminum content increases from 1.1 to 1.8%. Thus, it is preferred to control the upper aluminum limit to 1.3% but 1.5% would be acceptable for some applications.

TABLE V

| Oxidation Resistance at 2130° F. (1165° C.) For 1008 hours for Varying Aluminum Content | | |
|---|---|---|
| Alloy | % Al | Mass Change ($mg/cm^2$) |
| 1 | 1.42 | −16.5 |
| D | 1.1 | −20.2 |
| E | 1.3 | −22.2 |
| F | 1.5 | −31.2 |
| G | 1.8 | −43.5 |

As previously indicated, the effect of increasing titanium has been found to detract to oxidation resistance by increasing the rate of spall of the scale. Spalling of the scale also increases mass losses by permitting greater chromium vaporization from the unprotected substrate. Table VI sets forth the undescaled mass losses for a range of titanium values within the scope of the subject invention. Note that zirconium (alloys 1 and 6) tend to compensate for at least some of the titanium content with respect to mass change rates.

The data in Table VI might suggest that titanium should be as low as possible. However, titanium is beneficial in preventing AlN formation during high temperature exposure. Depending on the exposure temperature, a minimum titanium content can be defined based upon the maximum aluminum content (1.5%) of the alloy range of this invention. The minimum titanium content that is required in alloys to be used at 2192° F. (1200° C.), where the critical maximum aluminum to titanium ratio of about 5.5 exists, is that above which AlN will form. Thus, the titanium content must be about 0.27% if the aluminum content is 1.5%. For service at 2012° F. (1100° C.), the ratio increases to about 14, making the minimum titanium content about 0.11% for an alloy containing 1.5% aluminum. See Table VII.

TABLE VI

| Effect of Titanium on Oxidation Resistance at 2012° F. (1100° C.) for 1008 Hrs. | | |
|---|---|---|
| Alloy | (% Ti) | ($mg/cm^2$) |
| 8 | 0.01 | −2.0 |
| 9 | 0.08 | −4.9 |
| A | 0.33 | −25.5 |
| B | 0.56 | −36.2 |
| C | 0.84 | −36.6 |
| 1 | 0.40 | −8.7 |
| 6 | 0.39 | −9.8 |

Small amounts of yttrium have been found to enhance the grain size stabilization characteristics of the $(Zr_xTi_{1-x})C_yN_{1-y}$. This is shown in Table VIII for specimens of alloys 1, 3 and 4 exposed for 576 hours at 2130° F. (1163° C.). 0.05 to 0.15% yttrium is advantageous.

TABLE VIII

| Effect of Yttrium Content On Grain Size Stability on Alloys | | |
|---|---|---|
| Alloy | % Y | After 576 hrs./ 2130° F. (1165° C.) |
| 1 | 0.00 | 9 |
| 3 | 0.05 | 7 |
| 4 | 0.11 | 6 |

Given the foregoing, it will be noted that the subject invention provides nickel-chromium alloys which afford a combination of desirable metallurgical properties including (1) good oxidation resistance of elevated temperatures (2) high stress-rupture lives at such temperatures, and (3) a relatively stable microstructure. The alloys are characterized by (4) a substantially uniform distribution of $(Zr_xTi_{1-x})C_yN_{1-y}$ throughout the grains and grain boundaries. The nitrides are stable in the microstructure up to near the melting point provided at least 0.03 nitrogen, 0.05% zirconium and 0.1% titanium are present.

The alloy of the present invention is not only useful in connection with the production of rollers in furnaces for frit production, but is also deemed useful for heating elements, ignition tubes, radiant tubes, combustor components, burners heat exchangers, furnace industries, chemical manufactures and the petroleum and petrochemical processing industries are illustrative of industries in which the alloy of the invention is deemed particularly useful.

The term "balance iron" or "balance essentially iron" does not exclude the presence of other elements which do not adversely affect the basic characteristic of the subject alloy, including incidentals, e.g., deoxidizing elements, and impurities ordinarily present in such alloys. An alloy range for a given constituent may be used with the range or ranges given for the other elements of the alloy.

Although the present invention has been described in conjunction with preferred embodiments, it is to be understood that modifications and variations may be resorted to without departing from the spirit and scope of the invention, as those skilled in the art will readily understand. A range for a given constituent can be used with the ranges given for the other constituents of the

TABLE VII

| | | | Ratio | Presence of AlN After 1008 Hours | |
|---|---|---|---|---|---|
| Alloy | (% Al) | (% Ti) | (Al/Ti) | 2000° F. (1093° C.) | 2192° F. (1200° C.) |
| 8 | 1.24 | 0.01 | 124 | Yes | — |
| 9 | 1.17 | 0.08 | 14.6 | Yes | — |
| 10 | 1.25 | — | * | Yes | Yes |
| 11 | 1.35 | — | * | No | Yes |
| 12 | 1.33 | — | * | Yes | Yes |
| 13 | 1.35 | — | * | No | Yes |
| 14 | 1.35 | 0.11 | 12.3 | No | No |
| 15 | 1.31 | 0.10 | 13.1 | No | No |
| A | 1.30 | 0.33 | 3.9 | No | — |
| I | 1.44 | 0.24 | 6.0 | — | Yes |
| J | 1.50 | 0.29 | 5.2 | — | No |
| K | 1.19 | 0.34 | 3.5 | — | No |
| 1 | 1.42 | 0.40 | 3.6 | — | No |

alloy. Such modifications and variations are considered to be within the purview and scope of the invention and appended claims.

The embodiments of the invention in which an exclusive property or privilege is claimed are defined as follows:

1. A nickel-chromium-iron alloy characterized by (i) ease of manufacturing, (ii) a controlled grain size, (iii) enchanced oxidation resistance upwards of 1000° C. (1832° F.), and (iv) good stress rupture strength at temperatures upwards of about 1100° C., said alloy consisting essentially of about 19 to 28% chromium, about 55 to 75% nickel, about 0.75 to 2% aluminum, up to about 1% titanium, zirconium in a small but effective amount sufficient to facilitate the manufacturing process and up to about 0.5%, up to 1% each of silicon, molybdenum, manganese and niobium, up to about 0.1% carbon, a small but effective amount of nitrogen sufficient to combine with the zirconium to effect grain size control and up to about 0.1%, up to about 0.2% yttrium, with the balance being iron.

2. The alloy set forth in claim 1 and containing about 21 to 25% chromium, about 55 to 65% nickel, 0.8 to 1.5% aluminum, about 0.075 to 0.5% titanium, about 0.1 to 0.4% zirconium, 0.1 to 0.6% silicon, up to 0.8% molybdenum, up to 0.6% manganese, up to 0.4% niobium, about 0.04 to 0.1% carbon, about 0.02 to 0.08% nitrogen and up to 0.15% yttrium.

3. The alloy set forth in claim 2 containing at least 0.1% titanium and 0.15% zirconium.

4. The alloy set forth in claim 2 containing from 0.1 to 0.6% molybdenum.

5. The alloy set forth in claim 2 in which the nickel is 58 to 63%.

6. The alloy set forth in claim 1 in which the yttrium is present in an amount of about 0.02 to 0.15%.

7. The alloy set forth in claim 2 in which the yttrium is present in an amount of about 0.02 to 0.15%.

8. The alloy set forth in claim 1 containing from 0.1 to 0.6% silicon and up to 0.5% titanium in which the silicon and titanium are correlated such that the ratio therebetween is about 0.75:1::3:1.

9. The alloy set forth in claim 2 containing from 0.1 to 0.6% silicon and up to 0.5% titanium in which the silicon and titanium are correlated such that the ratio therebetween is about 0.8:1::3:1.

10. The alloy set forth in claim 1 in which the zirconium and titanium are correlated such that the ratio therebetween is from 0.1:1::60:1.

11. The alloy set forth in claim 2 in which the zirconium and titanium are correlated such that the ratio therebetween is from 0.1:1::60:1.

12. The alloy set forth in claim 1 in which the aluminum and the titanium plus 0.525x% zirconium are correlated such that the ratio therebetween is not greater than about 5.5 to 1 for service temperatures up to about 1200° C.

13. The alloy set forth in claim 2 in which the aluminum and the titanium plus 0.525x% zirconium are correlated such that the ratio therebetween is not greater than about 5.5 to 1 for service temperatures up to about 1200° C.

14. The alloy set forth in claim 8 in which the ratio between zirconium and titanium is from 0.1:1::60:1 and the ratio between the aluminum and titanium plus 0.525x% zirconium is not greater than 5.5 to 1 for service temperatures up to about 1200° C.

15. The alloy set forth in claim 9 in which the ratio between zirconium and titanium is from 0.1:1::60:1 and the ratio between the aluminum and titanium plus 0.525x% zirconium is not greater than 5.5 to 1 for service temperatures up to about 1200° C.

16. A furnace roller made from the alloy in claim 1.

17. A furnace roller made from the alloy in claim 2.

18. A furnace roller made from the alloy in claim 14.

19. A furnace roller made from the alloy in claim 15.

* * * * *